United States Patent [19]

Durante

[11] Patent Number: 4,835,821

[45] Date of Patent: Jun. 6, 1989

[54] NECKTIE FASTENING DEVICE WITH HIDDEN POCKET

[76] Inventor: Alan J. Durante, 702 N. Victoria Ave., Ventnor City, N.J. 08406

[21] Appl. No.: 143,018

[22] Filed: Jan. 12, 1988

[51] Int. Cl.[4] ..... A41D 25/04

[52] U.S. Cl. ..... 24/49 CF; 24/49 M; 24/56; 24/306; 2/144; 2/247; 2/DIG. 6

[58] Field of Search ..... 24/3 B, 3 F, 49 CF, 24/49 K, 49 M, 49 R, 49 C, 49 CC, 49 P, 49 CP, 49 S, 49 TS, 50, 54, 56, 65, 306; 2/144, 145, 157, DIG. 6, 247

[56] References Cited

U.S. PATENT DOCUMENTS

| | | | |
|---|---|---|---|
| 2,389,784 | 11/1945 | Kennedy | 24/49 TS |
| 2,749,553 | 6/1956 | Miller | 2/145 |
| 3,041,692 | 7/1962 | Olila | 24/49 K X |
| 3,206,765 | 9/1965 | Sherman | 2/144 |
| 3,374,508 | 3/1968 | Slimovitz . | |
| 3,405,408 | 10/1968 | Baker . | |
| 3,453,696 | 7/1969 | Mates | 24/49 CC |
| 3,802,032 | 4/1974 | Weed . | |
| 3,950,823 | 4/1976 | Schreter . | |
| 4,554,710 | 11/1985 | Grant | 24/49 CF |

*Primary Examiner*—Kenneth J. Dorner
*Assistant Examiner*—Laurie K. Cranmer
*Attorney, Agent, or Firm*—Fleit, Jacobson, Cohn & Price

[57] ABSTRACT

A necktie fastening device having a loop pile strip with two button holes for fastening to a shirt front. The loop pile strip having an outer surface and an inner surface which has an open topped pocket attached thereto in order to place an article or the like to be hidden from sight. A hook pile strip is placed between the designer label and the necktie so that when the loop pile strip and the hook pile strip are in position to be mated surface to surface, the necktie is secured and the necktie fastening device is invisible.

2 Claims, 1 Drawing Sheet

NECKTIE FASTENING DEVICE WITH HIDDEN POCKET

BACKGROUND OF THE INVENTION

1. Field of the Invention

This invention relates to a necktie fastening device for securing a necktie to a shirt. More specifically, this invention relates to a necktie fastening device which is hidden from view behind the necktie and further includes a hidden pocket for money, spare key, or the like.

2. Description of the Prior Art

There are many devices used to secure the loose ends of a necktie including conventional tie clasps or clips and tie tacks. However, these devices are visible when worn and pierce the ends of the necktie. This tends to mar a visible portion of the necktie after repeated use. Therefore, many of the conventional necktie holders cause considerable damage to the necktie.

SUMMARY OF THE INVENTION

The necktie fastening device of the present invention secures the necktie to the shirt, invisibily, without the use of clips or pins. The necktie fastening device of the present invention eliminates the need to pierce the ends of the necktie and thus does not mar the necktie. The present invention discloses a strip with loop pile which is connected to the shirt front by the use of button holes to receive the existing buttons on the shirt. This strip includes a hidden pocket sewn to the back inner surface thereof. This hidden pocket can hold a spare key or currency for emergency purposes. Also, there is a strip with hook pile which is attached to the tie panel in a partially underlying relation to the usually provided designer label. Thus, the necktie fastening device consists of the hook pile and loop pile fastening portions which are commercially available under the trademark "VELCRO". The device is placed in a surface to surface contact which secures the necktie in place. The device is separated by a peeling action.

OBJECTS OF THE INVENTION

An object of the invention is to provide a necktie fastening device which does not mar the necktie.

Another object of the invention is to provide a necktie fastening device which is hidden from view and secures the necktie to the shirt front.

Yet another object of the invention is to have a hidden pocket on the back plate of the loop pile strip of the fastening device for storing keys or the like for emergency purposes.

A further object of the invention is to provide the loop pile strip of the necktie fastening device with two button holes for fastening the device to the front of the shirt.

A still further object of the invention is to have the hook pile strip of the necktie fastening device slipped between the necktie and the designer label of the necktie.

These together with other objects and advantages which will become subsequently apparent reside in the details of construction and operation as more fully hereinafter described and claimed, reference being had to the accompanying drawings forming a part hereof, where in like numerals refer to like parts throughout.

DESCRIPTION OF THE PREFERRED EMBODIMENT

Figure 1:
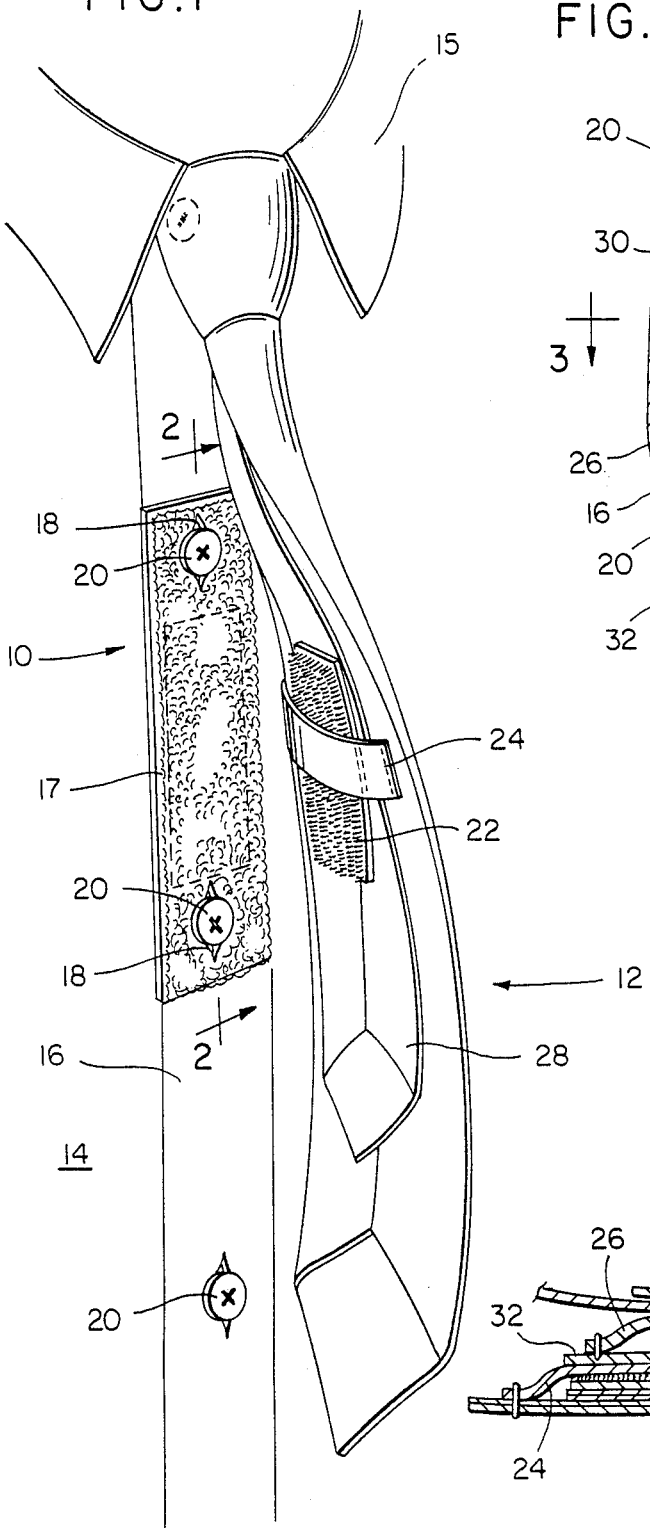
FIG. 1 is a perspective view illustrating the necktie fastening device of the present invention with the unique features incorporated therein.

Referring now specifically to the drawings, the necktie fastening device, generally indicated as 10, secures the necktie 12 to the shirt 14, invisibly, without the use of clips or pins. FIG. 1 illustrates the shirt collar 15 and shirt front 16 having a necktie 12 displayed. The necktie fastening device 10 has two parts. The loop pile strip 17 is attached to the front of the shirt 14 by means of button holes 18 which are connected to the buttons 20 of the shirt 14. The hook pile strip 22 is placed between the necktie 12 and the designer label 24.

The necktie fastening device 10 consists of the loop pile strip 17 and the hook pile strip 22 which are made from commercially available VELCRO and engage when placed in surface to surface contact. A peeling action is used to separate the hook pile strip 22 from the loop pile strip 17.

The loop pile strip 17 is approximately $4\frac{1}{8}$ inches in length and one inch in width. The loop pile strip 17 has two stitched button holes 18. The button holes are approximately $3\frac{1}{2}$ inches apart, center to center, which fasten the loop pile strip 17 to the shirt 14 and more specifically, to the shirt front 16. On the back side of the loop pile strip 17 is a pocket 26 which can house a spare key or currency or other like articles for emergency purposes.

The hook pile strip 22 is approximately 2 inches in length and 1 inch in width. The hook pile strip 22 is placed between the back part 28 of the necktie 12 and the designer label 24. With the hook pile strip 22 in place, it is now in position to be mated surface to surface with the loop pile strip 17. This secures the necktie 12 to the shirt front 16 and is invisible to the observer.

Figure 2:
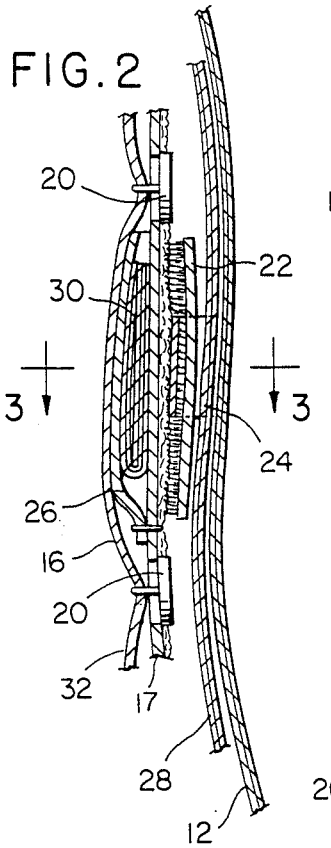
FIG. 2 is a sectional view, on an enlarged scale, taken substantially upon a plane passing along section line 2—2 on FIG. 1 illustrating the specific structural details of the improved and unique features of the invention.

FIG. 2 is a sectional view, on an enlarged scale, taken substantially upon a plane passing along section line 2—2 on FIG. 1 illustrating the necktie fastening device. The figure shows the button holes 18 with the buttons 20 protruding and connected to the loop pile strip 17. FIG. 2 shows the loop pile strip 17 and the pocket 26 stitched to the back of the loop pile strip 17 with the money or spare key or other like articles 30 stored. Also the figure illustrates the designer label 24 with the hook pile strip 22 in partially underlying relationship behind the label 24. The label 24 is attached to the necktie 12 in a manner contemplated by the manufacturer.

Figure 3:
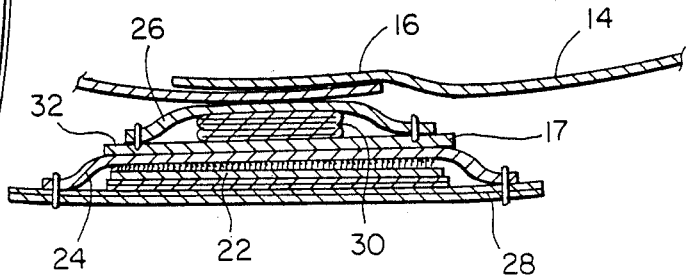
FIG. 3 is a sectional view, on an enlarged scale, taken substantially upon a plane passing along section line 3—3 on FIG. 2 further illustrating the specific structural details of the present invention.

FIG. 3 is a sectional view, on an enlarged scale, taken substantially upon a plane passing along section line 3—3 on FIG. 2 further illustrating the specific structural details of the necktie fastening device 10. FIG. 3 shows the compactness of the necktie fastening device 10 even with some currency 30 in the hidden pocket 26. The figure also shows the width of the device 10 and how the necktie 12 will completely cover the device 10 once the loop pile strip 17 and hook pile strip 22 are mated. Therefore, the device 10 is completely invisible from the observer.

Figure 4:
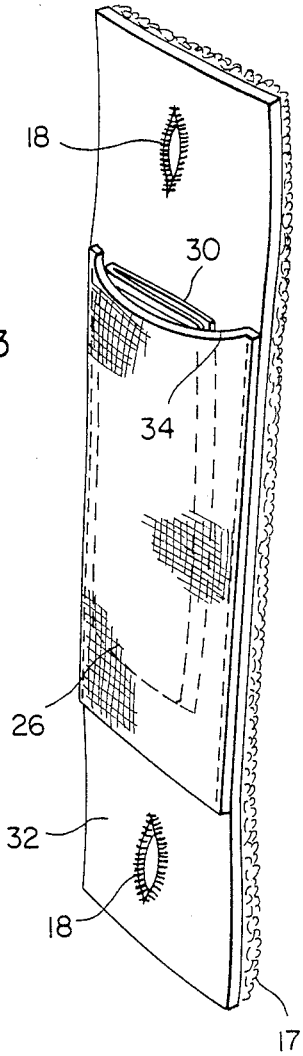
FIG. 4 is a perspective view, on an enlarged scale, illustrating the back plate and a hidden pocket of the present invention.

FIG. 4 is a perspective view, on an enlarged scale, illustrating the loop pile strip 17 including the inner surface 32 on which pocket 26 is stitched with one end 34 open to store an article 30 such as money or a spare key.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalence may be resulted to, falling within the scope of the invention.

What is claimed:

1. In combination with a shirt having a collar and a front opening formed by overlapping vertical edges releasably retained in closed relation by a plurality of vertically spaced buttons engaged through correspondingly spaced button holes, a necktie extending under the collar and formed into a knot at the upper end of the front opening with depending wide and narrow ends of the tie overlying the front opening, said wide end of the tie having a label strip disposed transversely on the inner surface thereof and secured to the inner surface of the wide end of the tie at spaced points to enable the narrow end of the tie to be inserted under the label strip to retain the tie ends in aligned overlying relation, a fastening device releasably securing the tie ends to the front of the shirt, said fastening device comprising a generally rectangular strip of flexible material having a pair of spaced upper and lower button holes therein receiving a pair of spaced buttons on the front opening of the shirt, a rectangular strip of material connected with the ends of the tie, one of said strips having loop pile on the outer surface thereof and the other strip having hook pile on the outer surface thereof with the loop pile and hook pile releasably connecting the strips together when pressed into surface-to-surface contact thereby securing both the narrow and wide ends of the tie in overlying relation to the front opening on the shirt, said strip having the button holes therein including a rectangular panel attached to the inner surface of said strip having stitching along the bottom and side edges of the panel with the upper edge of the panel being free of the inner surface of the strip to form an open topped pocket, the free upper edge of the panel being disposed closely adjacent to and slightly below the upper button hole to retain items in the pocket when a button extends through the upper button hole in the strip.

2. The combination as defined in claim 1 wherein said strips are of less width than the tie ends to conceal the fastening device, said strip connected with the ends of the tie extending under the label strip and extending above and below the label strip for releasable connection with the rectangular strip on the front opening on the shirt above and below the label strip to connect the rectangular strips together with the label strip retained between the rectangular strips and the tie ends retained in adjacent overlying relation to the front opening in the shirt.

* * * * *